US005464204A

United States Patent [19]

Suzuki

[11] Patent Number: 5,464,204

[45] Date of Patent: Nov. 7, 1995

[54] PAPER FEED CONTROLLING DEVICE

[75] Inventor: Katsunori Suzuki, Langenhagen, Germany

[73] Assignee: Minolta Co., Ltd., Osaka, Japan

[21] Appl. No.: 187,305

[22] Filed: Jan. 27, 1994

[30] Foreign Application Priority Data

Jan. 27, 1993 [JP] Japan ..... 5-011877

[51] Int. Cl.[6] ..... B65H 7/08

[52] U.S. Cl. ..... 271/110; 271/258.04

[58] Field of Search ..... 271/110, 258, 271/259, 265, 266; 355/309, 311, 296, 299

[56] References Cited

U.S. PATENT DOCUMENTS

| | | | |
|---|---|---|---|
| 3,948,510 | 4/1976 | Iwamoto et al. | 271/110 X |
| 4,159,109 | 6/1979 | Watson et al. | 271/259 |
| 4,317,138 | 2/1982 | Bryan et al. | 271/110 X |
| 5,052,673 | 10/1991 | Tokuda et al. | 271/110 X |
| 5,156,385 | 10/1992 | Muto et al. | 271/110 X |

*Primary Examiner*—David H. Bollinger
*Attorney, Agent, or Firm*—Price, Gess & Ubell

[57] ABSTRACT

A paper feed controlling device for a printer includes a feeding apparatus for feeding recording paper along a predetermined path. The size of the image to be printed with toner particles is determined. A detector determines the size of the paper as it travels along a predetermined path. The image size and the detected paper size can be compared. A controller can control the feeding apparatus prior to the completion of the detection of the size of the paper so as to prohibit the initiation of a subsequent feeding of recording paper and when it is determined that the image size is inappropriate. Toner particles can be cleaned from a photosensitive drum in preparation for a subsequent printing operation.

9 Claims, 5 Drawing Sheets

PAPER FEED CONTROLLING DEVICE

BACKGROUND OF THE INVENTION

1. Field of the Invention

This invention relates to a paper feed controlling device which is used in a laser printer, for example.

2. Description of the Prior Art

In recent years, laser printers have been prevailing as means for printing character information and image information. These laser printers are adapted to select the size of recording paper from a plurality of sizes in conformity to a given size of images to be printed. Generally, the size of recording paper to be used is freely set to fit the size of a given image by a manual operation performed by an operator or in accordance with a command issued from a host computer to which the laser printer is connected. After this setting is completed, recording papers of the size so set are fed to the laser printer and images of the matching size are printed therein on the recording papers. Unlike the laser printers of the type adapted to feed recording papers of a size conforming to the size of recording paper which has been set as described above, there are laser printers of the type endowed with the function of matching the size of recording paper with the size of an image about to be printed. The laser printers of this type are so adapted as to recognize the size of a recording paper about to be fed after the feeding of this recording paper has been completed.

When a laser printer which is adapted to recognize the size of a recording paper after the feeding of this recording paper has been completed is operated at a relatively slow printing speed, since the feeding of a second recording sheet is effected after the size of the first recording paper has been recognized, the possibility that the relevant image is accidentally printed on a recording paper of a size different from the size of the image could occur on only one recording paper at most. When this laser printer is operated at a speed faster than the ordinary printing speed, namely at a speed enough to attain the so-called maximum throughput, since the feeding of the second recording paper is initiated before the size of the first recording paper already fed is recognized, it is not impossible that an image will be printed on two recording papers of a size not matched with the size of the image.

SUMMARY OF THE INVENTION

This invention has for its object the provision of a paper feed controlling device which, in the operation of a laser printer at a high speed intended to attain such a maximum throughput as mentioned above, does not allow the feeding of a second recording paper to be initiated until after the size of a first recording paper already fed has been detected.

The paper feed controlling device according to this invention comprises feeding means for feeding a recording paper, paper size detection means for detecting the size of said recording paper fed from said feeding means while said recording paper is in transit on a paper path, and control means for controlling said feeding means prior to completion of said detection of the size of said recording paper by said paper size detection means so as to prohibit said feeding means from initiating the feeding of a subsequent recording paper until after the size of said recording paper fed from said paper feeding means has been detected.

Further, the paper feed controlling device according to this invention comprises feeding means for feeding a recording paper, paper size detection means for determining the size of said recording paper fed from said feeding means while said recording paper is in transit on a paper path by detecting the leading and trailing ends of said recording paper, timing means for measuring a prescribed interval from the time of detection of the leading end of said fed paper, and control means for controlling said feeding means prior to completion of said detection of the size of said recording paper by said paper size detection means so as to initiate the feeding of a subsequent recording paper after the size of said recording paper is detected by said size detection means or after the elapse of said prescribed interval is perceived by said timing means and said detection of the size of said recording paper has been completed.

In accordance with this invention, when the size of a recording paper about to be fed has not yet been detected, the feeding of the subsequent recording paper is not initiated until after the size of the first recording paper has been detected. Even when the laser printer is operated at a high speed, therefore, the number of recording papers of unmatched sizes on which an image is accidentally printed can be minimized.

DETAILED DESCRIPTION OF THE INVENTION

Figure 1:
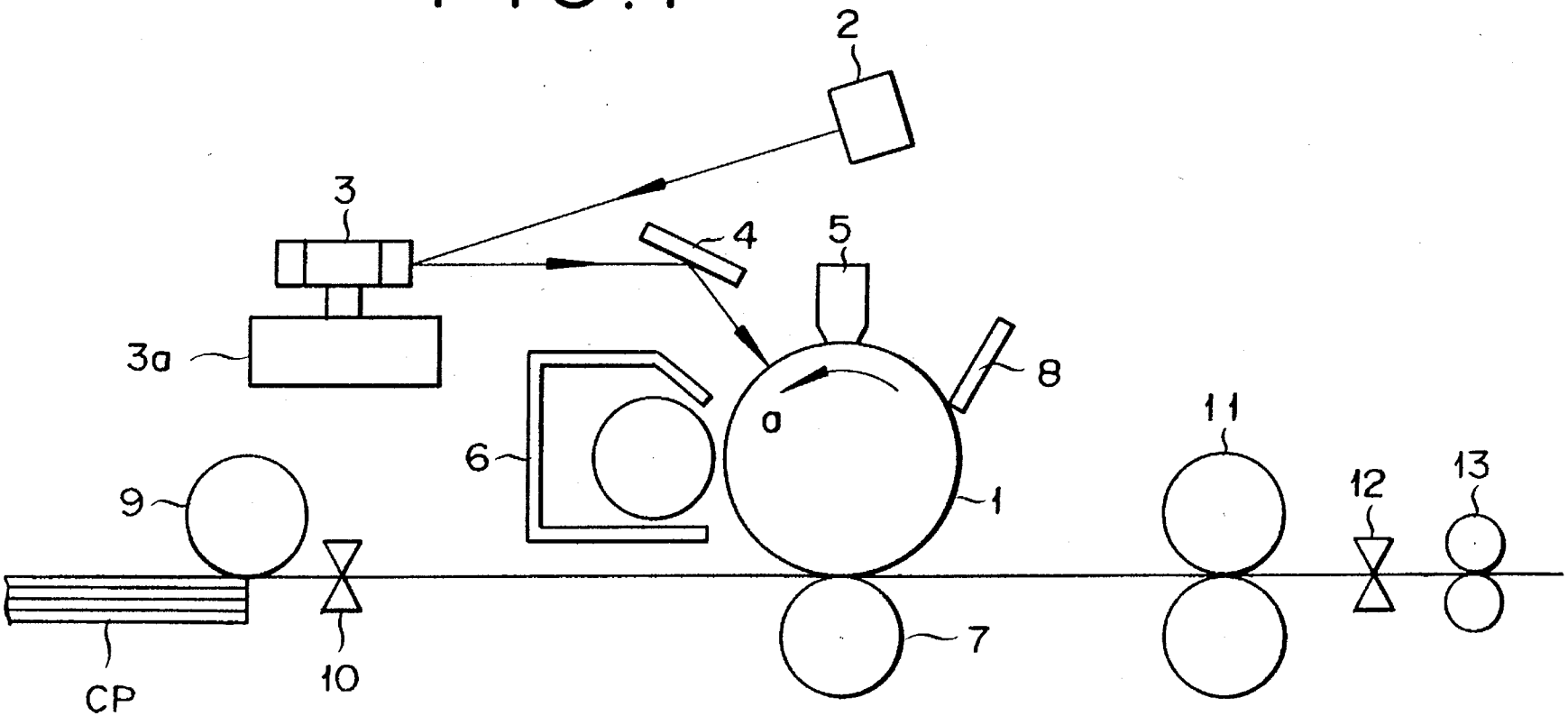
FIG. 1 is a schematic structural diagram illustrating the construction of a laser printer on which a paper feed controlling device contemplated by this invention is mounted.

FIG. 1 portrays schematically the construction of a laser printer on which the paper feed controlling device of this invention is mounted.

The surface of a photosensitive drum 1 is electrified to a prescribed electric charge with an electrifying brush 5. A laser beam which is emitted from a semiconductor laser oscillator 2 and modulated with an image signal is first caused to sweep in a main scanning direction by a polygon mirror 3 rotated with a polygon mirror drive motor 3*a* and then reflected on a reflection mirror 4 and consequently allowed to impinge on the photosensitive drum 1. The photosensitive drum 1 is rotated for the sake of sub-scanning in the direction indicated by the letter "a" in the diagram. In consequence of the operation described above, an electrostatic latent image is formed on the surface of the photosensitive drum 1. This electrostatic latent image is developed with a developer 6 and converted into a toner image.

A paper feed roller 9 starts feeding recording papers CP in response to a command to feed papers. Each recording paper CP in transit which has the momentary state of motion thereof detected by a paper feed sensor 10 is advanced on a paper path and conveyed with such a timing to a position for image transfer that the toner image on the photosensitive drum 1 reaches the position exactly at the same moment as the recording paper. At this moment, since a bias opposite in polarity to the electric charge of the toner on the photosensitive drum 1 is applied to a transfer roller 7, the toner image on the photosensitive drum 1 is transferred onto the recording paper CP. The toner image thus transferred to the recording paper CP is fixed by a fixing roller 11 and then discharged by a paper discharge roller 13. This discharge of the recording paper CP is detected by a paper discharge sensor 12. The part of the toner which remains on the photosensitive drum 1 after the transfer of the toner image is removed from the drum 1 by a cleaning blade 8.

Figure 2:
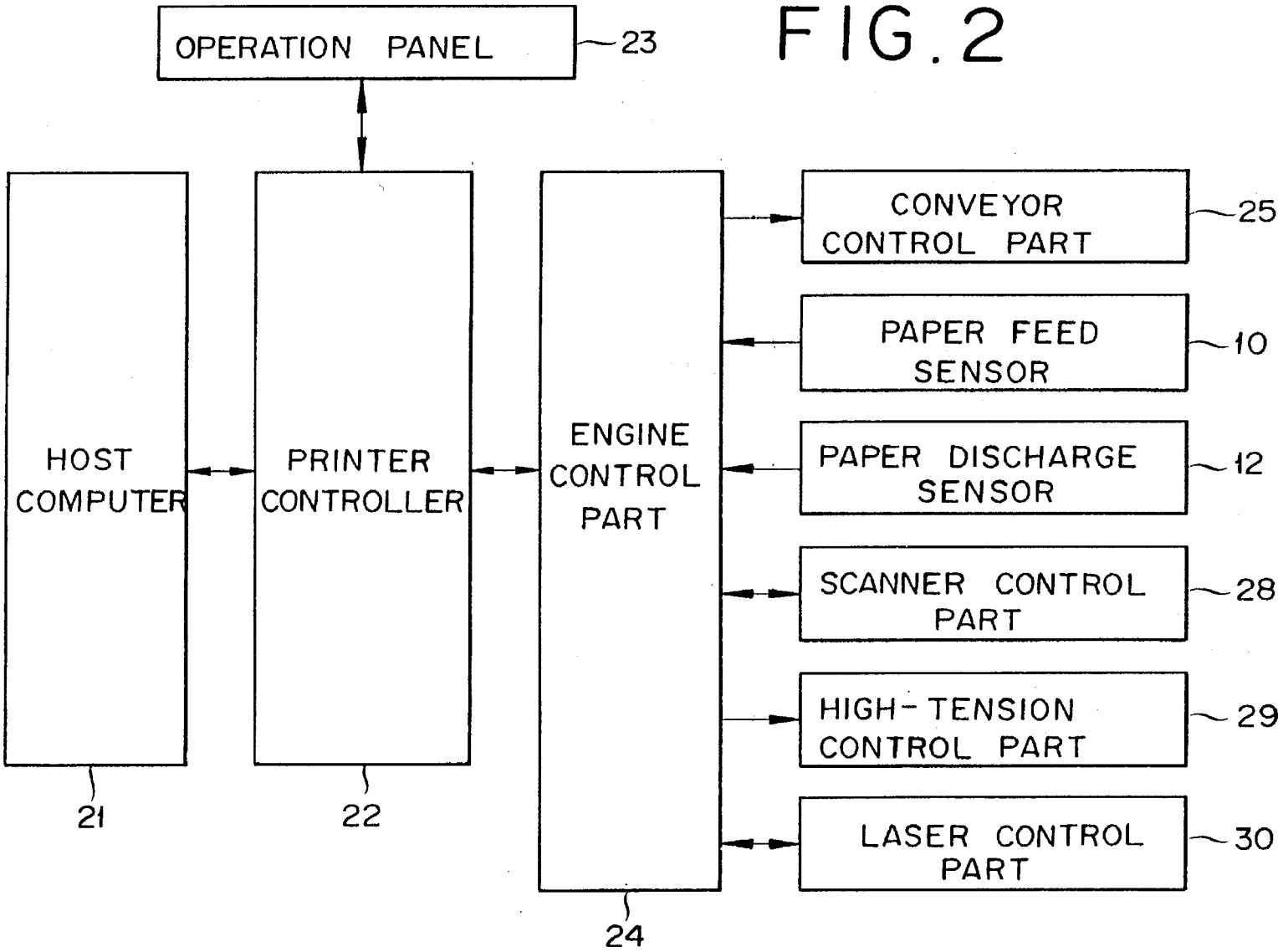
FIG. 2 is a block diagram illustrating the construction of a control system of the laser printer on which the paper feed controlling device of this invention is mounted.

FIG. 2 is a block diagram depicting a control system of a laser printer which is provided with the paper feed controlling device of this invention.

A host computer 21 serves to issue a print demand signal for demanding the printing of an image which has been read in from an image reading device (not shown) or the like and convert the image so read in into an image signal and emit the image signal. A printer controller 22 serves to receive the print demand signal from the host computer 21 and, in response thereto, issue to an engine control part 24 a command for starting the printing operation. An operation panel 23 serves to furnish the printer controller 22 with printer control information including the number of recording papers to be used for printing. The engine control part 24 serves to control various parts of the printer in accordance with the command from the printer controller 22. A conveyor control part 25 serves to control the feeding of recording papers CP and a scanner control part 28 controls the scanning which is effected by the polygon mirror 3. A high-tension control part 29 serves to effect high-tension control for the sake of electrification of the photosensitive drum 1, application of development bias, and application of the potential of transfer bias to the transfer roller 7. A laser control part 30 serves to control the modulation of a laser beam. The paper feed sensor 10 is used as a sensor for recognizing the size of a recording paper CP in transit. The recognition involved herein will be described specifically herein below.

The printer controller 22, on receiving the print demand signal from the host computer 21, issues to the engine control part 24 a command for the sake of printing. In response to this command, the engine control part 24 issues a paper feed command signal by way of a command to start paper feed to the conveyor control part 25 and, at the same time, commands the scanner control part 28 to prepare itself for a scanning operation and sets the photosensitive drum 1 for electrification and application of a development bias through the medium of the high-tension control part 29 and thereby completes preparation for the printing operation. The engine control part 24 issues a vertical synchronization demand signal to the printer controller 22 and, on receiving a vertical synchronization signal, commands the laser control part 30 to modulate the laser beam. In response thereto, the laser control part 30 modulates the laser beam based on the image signal introduced from the host computer 21 via the printer controller 22 and the engine control part 24, with the result that an electrostatic latent image is formed on the photosensitive drum 1.

In the series of operations described above, the feeding of recording papers CP consists in sequentially extracting the recording papers CP from a paper feed cassette in compliance with a paper feed command signal issued from the engine control part 24. The laser printer in this embodiment is adapted to recognize the size of the recording papers CP being fed thereto as described above. This recognition of the size of recording papers CP is effected as follows.

The size of a recording paper CP in transit to the site of printing is recognized on the basis of the length of the recording paper CP in the direction of conveyance which is detected by the paper feed sensor 10. Since this length cannot be directly measured, this recognition is accomplished by making use of the points of time at which the leading end and the trailing end of the recording paper CP pass the paper feed sensor 10 which is disposed in the proximity of the paper feed roller 9 on the path for conveyance of recording papers CP. In other words, the size of the recording paper CP is recognized from the interval between the time the leading end of the recording paper CP is detected by the paper feed sensor 10 and the time the trailing end thereof is detected by the paper feed sensor 10. The size of recording papers CP, therefore, is recognized at the moment at which the trailing end of the first recording paper CP being conveyed to the site of printing is detected by the paper feed sensor 10. When the length of the recording paper in the direction of conveyance is recognized, the length thereof in the direction of width is automatically recognized from the standard sizes of recording papers.

Figure 3A:
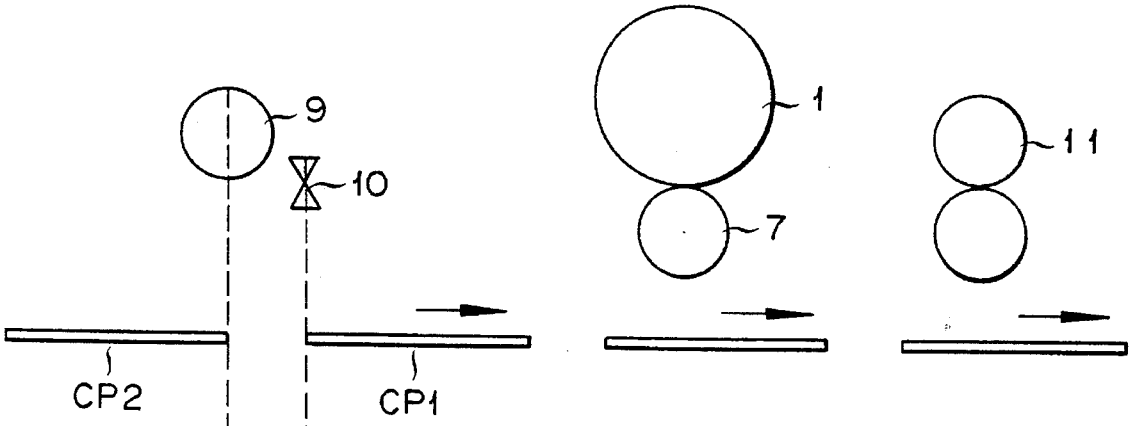
FIG. 3*a* and 3*b* are diagrams for aiding in the description of the operation of the paper feed controlling device of this invention.
Figure 3B:
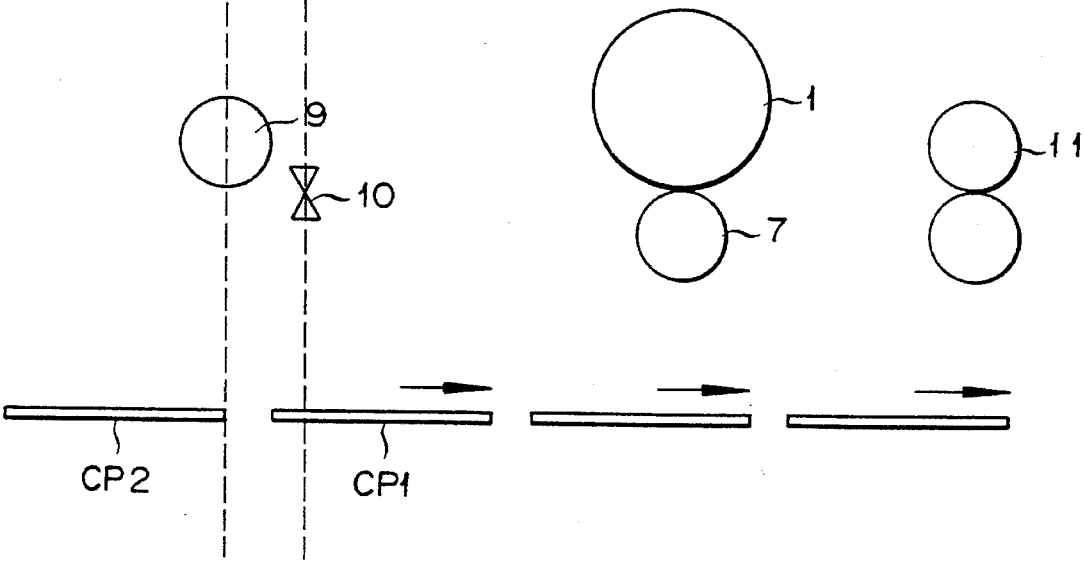

In the laser printer which is adapted to accomplish the recognition of the size of recording papers being fed by causing the first of recording papers to pass the paper feed sensor 10, the feeding interval between the successive recording papers CP can be curtailed by setting the printing speed so as to obtain the maximum throughput and exalt the printer's ability. FIG. 3 depicts the difference in paper feeding interval due to the difference in printer capacity. In the case of a high-speed print (the printing speed capable of obtaining the maximum throughput) at which recording papers are fed at an interval as shown in FIG. 3*b*, the feeding of the next recording paper CP2 is initiated before the trailing end of the first recording paper CP1 is detected by the paper feed sensor 10. The size of the first recording paper CP1 which has been fed out, therefore, is recognized while the next recording paper CP2 is still in transit to the site of printing. To eliminate this drawback, the paper feed controlling device according with this invention so operates that, when the size of the recording paper CP has not yet been recognized, the feeding of the next recording paper CP2 is prohibited until after the feeding of the first recording paper CP1 is initiated and the trailing end of this recording paper CP1 is detected by the paper feed sensor 10 as illustrated in FIG. 3*a*. After the size of the recording paper CP1 has been recognized, the high-speed print is effected at such a speed as illustrated in FIG. 3*b*. Owing to the control which is effected as described above, the printing of a given image on recording papers of a size conforming with the size of the image is infallibly carried out at least from the second recording paper onward.

Figure 4:
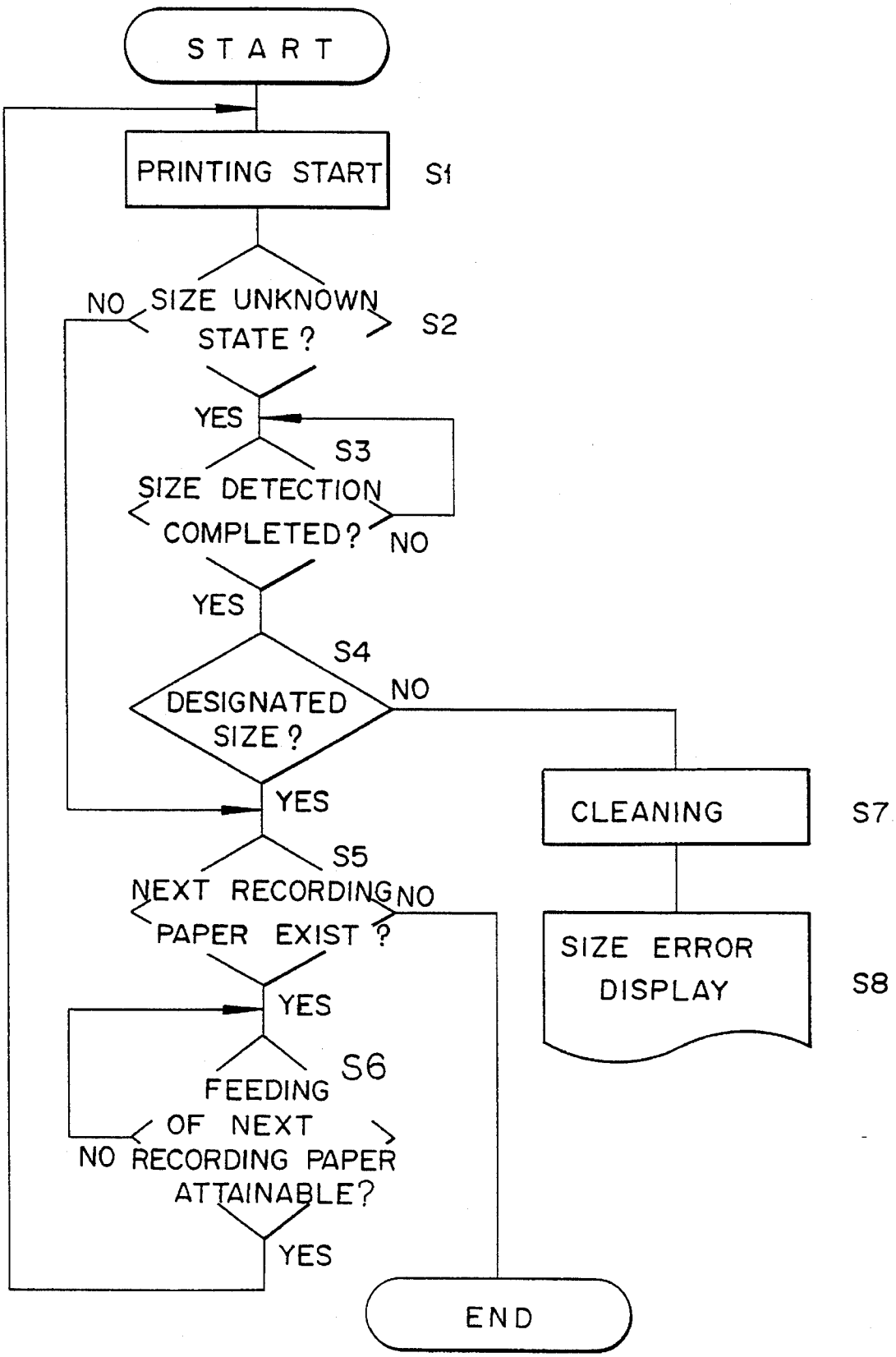
FIG. 4 is a flow chart for depicting the operation of the paper feed controlling device of this invention.

Now that the operation of this invention has been outlined, it will be described more specifically below with reference to the flow chart of FIG. 4. This flow chart pertains to the printer controller 22.

Figures 5A, 5B:
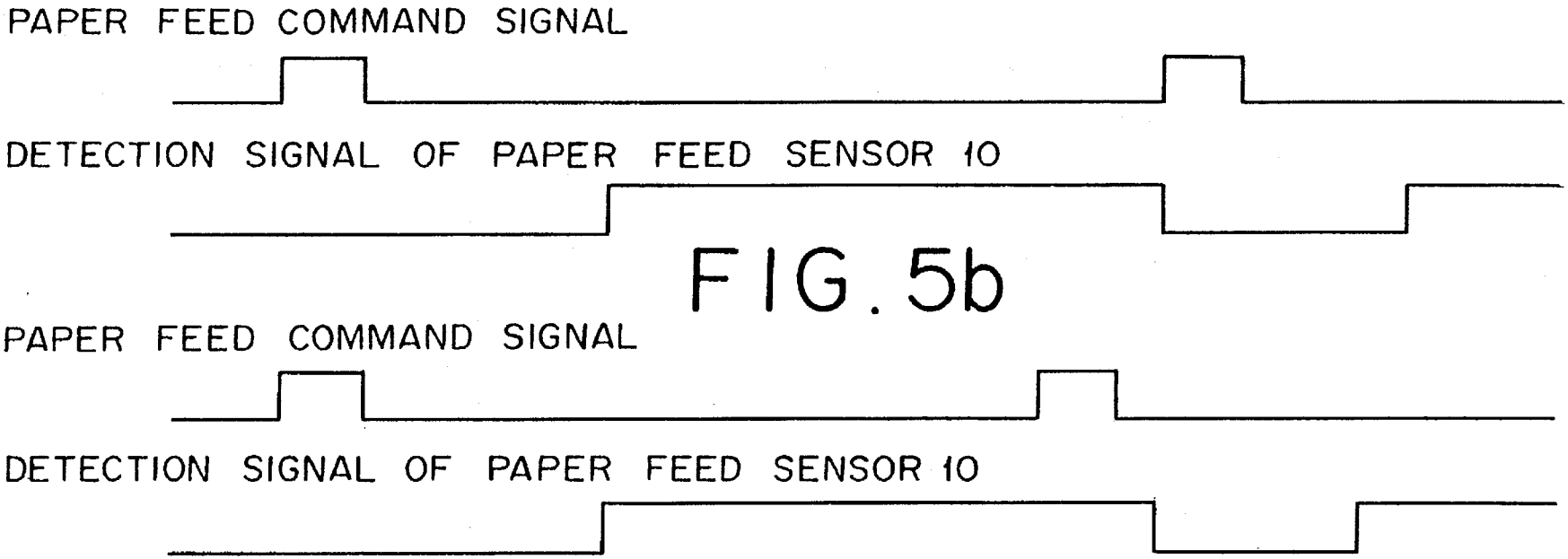
FIG. 5*a* and 5*b* are diagrams illustrating the timing of paper feed.

The printer controller 22 issues a command to start printing to the engine control part 24 when a print demand signal is issued from the operation panel 23 or the host computer 21. The engine control part 24, on receiving this command, issues such a paper feed command signal as shown in FIG. 5 to the conveyor control part 25, with the result that the paper feed roller 9 is set rotating to start the feeding of recording papers (S1). At this time, the printer controller 22 awaits recognition of the size of the recording paper CP already fed out when no recognition has yet been made as to the size of this recording paper CP. The paper feed command signal is allowed to be issued only after the paper feed sensor 10 has detected the trailing end of the recording paper CP as illustrated in FIG. 5*a* (after the HI state has been changed to the LOW state). In the embodiment illustrated in FIG. 5*a*, the paper feed command signal is issued about at the same time that the trailing end of the recording paper CP has been detected. When the printer controller 22 has already recognized the size of the recording paper CP in this case, the feeding of the next recording paper is carried out in accordance with the paper feed command signal which is issued solely on the condition that the processing for image formation (a series of process necessary for the formation of an image on a recording paper) has been already completed on the previous recording paper. In short, as shown in FIG. 5*b*, the paper feed command signal is issued depending solely on the completion of the processing for image formation irrespectively of the detection of the trailing end of the recording paper CP by the paper feed sensor 10. The timing of the issuance of the paper feed command signal in this case is actually set by a timer. The reason for the use of the timer is that the possibility of a plurality of recording papers being simultaneously fed out must be taken into consideration when the high-speed print is to be effected (S2, S3).

Then, the printer controller 22 proceeds to judge whether or not there exists a next recording paper to be printed or whether or not the feeding of the next recording paper is attainable when the size of the recording paper CP which has been detected conforms with the size of an image issued from the host computer 21, namely when the detected size is equal to the designated size. The printing operation is terminated when the absence of a next recording paper is discerned. When the presence of a next recording paper is discerned, the operation is returned to the step of S1 and made to follow the procedure described thus far on the condition that the series of treatments for the formation of an image on the preceding recording paper have been completed (the state allowing the feeding of the next recording paper) (S4 to S6). Incidentally, the paper feed signal which is issued on the condition of the state ready for the feeding of the next recording paper is actually issued at the point of time that a prescribed time has been counted down by the timer after the leading end of the recording paper has been detected.

At the step of S4, when the size of the recording paper CP which has been detected fails to conform with the size of the image, namely when the detected size differs from the designated size, the printer controller 22 commands the engine control part 24 to clean the transfer roller 7 by removing the residual toner adhering to the surface thereof. Specifically, by applying a bias of opposite polarity to the transfer roller 7, the toner adhering to the transfer roller 7 is transferred onto the photosensitive drum 1 and then removed therefrom with the cleaning blade 8. This cleaning is necessary for the following reason. The problem of partial loss of a printed image does not arise when the size of a recording paper fed to the site of printing is larger than the size of an image being printed. When the relation between the two sizes under discussion is reversed, however, not only the problem that the image is printed on the recording paper in a form incomplete because of partial loss thereof but also the problem that the toner forming the missing part of the image is directly deposited on the transfer roller 7 and suffered to smear the recording papers to be subsequently fed (S7).

After this processing is completed, the printer controller 22 displays a 37 size error" on the operation panel 23 (S8) and informs the operator of the fact that the recording paper CP is not in the conforming size.

By controlling the feeding of recording papers as described above, the possibility of an image being printed on a recording paper of a size not conforming with the size of the image can be minimized. At the point of time at which the feeding of the second recording paper is to be initiated, the size of the recording paper already fed out has been already recognized. Thus, when the size of the recording paper is not in conformity with the size of the image, the alarm noticing this fact can be issued and the conveyance of the recording paper can be discontinued. Further, when the size of the first recording paper does not conform with the size of the image, the conveyance of the second recording paper can be allowed to be initiated after the transfer roller 7 has been cleaned. Thus, the otherwise inevitable smearing of the second recording paper with the residual toner on the transfer roller 7 can be precluded and, at the same time, the printing of the image on the second recording paper can be carried out.

In the embodiment of this invention which is not depicted herein in the form of a detailed flow chart, when the size of the first recording paper does not conform with the size of the image, the size of the image can be forcibly made to conform with the size of the second recording paper by the use of the conventional technique of contraction or enlargement prior to the printing of the image on the second recording paper. For the purpose of preventing the part of the image protruding out of the recording paper from being printed, this invention can nullify the part of the image data corresponding to the protruding part of the recording paper and allow only the part of the image data falling within the area of the recording paper to be printed.

Though the device of this embodiment is depicted as possessing one paper feed port, this invention can be applied to a device which uses a plurality of paper feed port. In this case, if the size of the recording paper fed from the initially set feed port is determined to be in inconformity with the size of an image to be printed, the device may be controlled to switch to another feed port and output a command to print again.

To derive the maximum throughput from the device, the practice of manually setting the size of recording paper by means of the operating panel instead of utilizing the size detected by the device has prevailed to date. The device of this invention, when operated as demonstrated in the present embodiment, obviates the necessity of relying on the manual setting of the size, permits exaltation of the operational efficiency, and precludes occurrence of a mistake in the manual setting of size.

What is claimed is:

1. A paper feed controlling device comprising:

feeding means for feeding a recording paper;

paper size detection means for detecting the size of said recording paper fed from said feeding means while said recording paper is in transit on a paper path; and control means for controlling said feeding means prior to completion of said detection of the size of said recording paper by said paper size detection means so as to prohibit said feeding means from initiating the feeding of a subsequent recording paper until after the size of said recording paper fed from said paper feeding means has been detected.

2. A paper feed controlling device according to claim 1, wherein said device further comprises determining means for determining whether or not the size of said recording paper detected by said paper size detection means conforms with the size of an image to be printed and said control means prohibits said feeding means from initiating the feeding of a subsequent recording paper when said detection of the size of said recording paper by said size detection means is completed and said determining means has determined that the detected size of said recording paper is not in conformity with the size of an image to be printed.

3. A paper feed controlling device according to claim 2, wherein said control means commands said feeding means to initiate the feeding of a subsequent recording paper after said paper size detection means has completed said detection of the size of recording paper and said determining means has determined that the detected size of said recording paper conforms with the size of an image to be printed.

4. A paper feed controlling device according to claim 2, further comprising a display which, when said determining means has confirmed an inconformity of the size of said recording paper detected by said paper size detection means with the size of an image to be printed, displays an indication of the inconformity.

5. A paper feed controlling device according to claim 2, wherein said control means, on perceiving the fact that said determining means has confirmed inconformity of the size of said recording paper detected by said paper size detection means with the size of an image to be printed, cleans a transfer roller to remove toner particles adhering to the surface thereof.

6. A paper feed controlling device according to claim 2, wherein said control means, on perceiving the fact that said determining means has confirmed inconformity of the size of said recording paper detected by said paper size detection means with the size of an image to be printed, changes the size of said image so as to conform with the size of said recording paper.

7. A paper feeding controlling device comprising;

feeding means for feeding a recording paper;

paper size detection means for determining the size of said recording paper fed from said feeding means while said recording paper is in transit on a paper path by detecting the leading and trailing ends of said recording paper;

timing means for measuring a prescribed interval from the time of detection of the leading end of said fed paper; and control means for controlling said feeding means, when a size detection of a paper fed by said feeding means has not been completed by said paper size detection means, to feed a subsequent recording paper after completion of the detection of the paper size by said size detection means, and for controlling said feeding means, when the size detection has been completed, to feed a subsequent paper after a predetermined time is timed by said timing means.

8. A paper feed controlling device according to claim 7, wherein said device further comprises determining means for determining whether or not the size of said recording paper detected by said paper size detection means conforms with the size of an image to be printed and said control means prohibits said feeding means from initiating the feeding of a subsequent recording paper when said determining means determines that the detected size of said recording paper is not in conformity with the size of an image to be printed.

9. A paper feed controlling device for a printer unit comprising:

feeding means for feeding a recording paper along a predetermined path;

image means for providing an image on the recording paper with toner particles;

means for determining the size of the image to be printed;

paper size detection means, operatively mounted adjacent the predetermined path and before the image means, for detecting the size of said recording paper fed from said feeding means while said recording paper is in transit on said predetermined paper path;

means for comparing the image size with the detected paper size; and control means for controlling said feeding means, prior to the completion of said detection of the size of said recording paper by said paper size detection means so as to prohibit said feeding means from initiating the feeding of a subsequent recording paper until after the size of said recording paper fed from said paper feeding means has been detected, and for cleaning toner particles from the image means when the image size is determined to be inappropriate for the detected paper size.

* * * * *